US005597018A

United States Patent [19]

Shipman

[11] Patent Number: 5,597,018

[45] Date of Patent: Jan. 28, 1997

[54] BUNDLE TIE TIGHTENING AND CUT OFF TOOL

[76] Inventor: Barry Shipman, P.O. Box 3916, Christiansted, St. Croix, Virgin Islands (U.S.), 00822

[21] Appl. No.: 366,270

[22] Filed: Dec. 29, 1994

[51] Int. Cl.[6] ..... B21F 9/02

[52] U.S. Cl. ..... 140/123.6; 140/93.2

[58] Field of Search ..... 140/93 A, 93.2, 140/123.6

[56] References Cited

U.S. PATENT DOCUMENTS

| | | | |
|---|---|---|---|
| Re. 30,996 | 7/1982 | Pobuta and Dolgos . | |
| 3,014,506 | 12/1961 | Crimmins et al. | 140/93.2 |
| 3,169,560 | 2/1965 | Caveney and Moody . | |
| 3,645,302 | 2/1972 | Caveney, Moody and Roberson . | |
| 3,810,499 | 5/1974 | Benfer . | |
| 3,993,109 | 11/1976 | Fortsch . | |
| 4,081,002 | 3/1978 | Violi . | |
| 4,129,157 | 12/1978 | Sciolotto . | |
| 4,178,973 | 12/1979 | Collier and Owen . | |
| 4,202,384 | 5/1980 | Aubert . | |
| 4,252,158 | 2/1981 | McDade . | |
| 4,321,952 | 3/1982 | Natkins . | |

*Primary Examiner*—Lowell A. Larson
*Attorney, Agent, or Firm*—Walker, McKenzie & Walker, P.C.

[57] ABSTRACT

A tool is disclosed for tightening and trimming the loop formed by a self-locking strap around a bundle of articles. A strap stop is driven away from the apertured head of said self-locking strap by means of a carrier lever. Bearing against said apertured head is an excess strap cutter either fixed to or ratchetting within said carrier lever. Said cutter severs the excess strap protruding through said apertured head when said tool is rotated so as to engage the cutter blades with said excess strap.

14 Claims, 15 Drawing Sheets

BUNDLE TIE TIGHTENING AND CUT OFF TOOL

BACKGROUND—FIELD OF INVENTION

The invention relates to a hand operated tool used for tightening and cutting the excess portion of self-locking straps and more particularly where such straps are used to bundle a plurality of conductors into cables of conductors to form a harness.

BACKGROUND—DESCRIPTION OF PRIOR ART

Heretofore bundle tie tightening and cut off tools required operational motions and had a bulk that prohibited their use in certain confined areas such as behind instrument panels. One such tool is shown in U.S. Pat. No. 4,081,002 issued Mar. 28, 1978 to Mario Violi entitled "Tool for Tightening Clamps." this tool offers the capacity for remotely reaching work areas through the embodiment of a barrel-portion of considerable length. A straight line of access is still required however, and a longer barrel-portion increases the bulk of the tool.

A second such tool is shown in U.S. Pat. No. 3,993,109 issued Nov. 23, 1976 to William G. Fortsch entitled "Strap Tightening and Severing Tool." This hand supported, hand operated tool offers simplicity and a smaller size over many prior art devices. A limit to the utility of this tool is still found, however, in its bulk. In confined areas its utility Is also limited by the required hand support and range of finger/thumb articulation during operation.

Another alternative is to tighten the self-locking strap with an unaided hand and then cut off the excess strap by means of a naked blade or diagonal cutters. In this manner, the bundle tie may lack sufficient tightness and the surrounding items in a confined installation may be unintentionally cut and damaged. Furthermore, an undesirable sharp end will be left protruding from the self-locking strap.

OBJECTS AND SUMMARY OF INVENTION

Accordingly it is an object of this invention to provide an improved tool for tightening self-locking straps about a plurality of articles.

Another object of this invention is to provide a tool which is of simple construction, having fewer parts, being smaller, lighter, less expensive to produce, easier to transport, more convenient to carry and which is usable in confined spaces.

Another object of this invention is to provide a tool with independent strap tightening and strap tail excess severing functions selectable by the operator.

A further object of this invention is to provide a tool which is self supporting while engaging the strap tail, thereby enabling the operator to change to a minimal finger grip while continuing a tightening function or commencing strap tail excess severing functions in a confined space.

Another object of this invention is to provide a tool enabling the operator to perform the strap tightening function in confined spaces.

Another object of this invention is to provide a tool enabling the operator to perform the strap tail excess severing function in a confined space.

Another object of this invention is to function without damaging surrounding items within a confined installation.

It is yet another object of this invention to provide a tool operative in confined spaces using only a thumb and two finger tips in close opposition.

Further objects and advantages of my invention will become apparent from a consideration of the drawings and ensuing description thereof.

BRIEF DESCRIPTION OF THE DRAWINGS

Details of seven single element and one three element embodiments of the invention are shown in the accompanying drawings in which similar parts are given similar reference characters.

DRAWING REFERENCE NUMERALS

Figure 1:
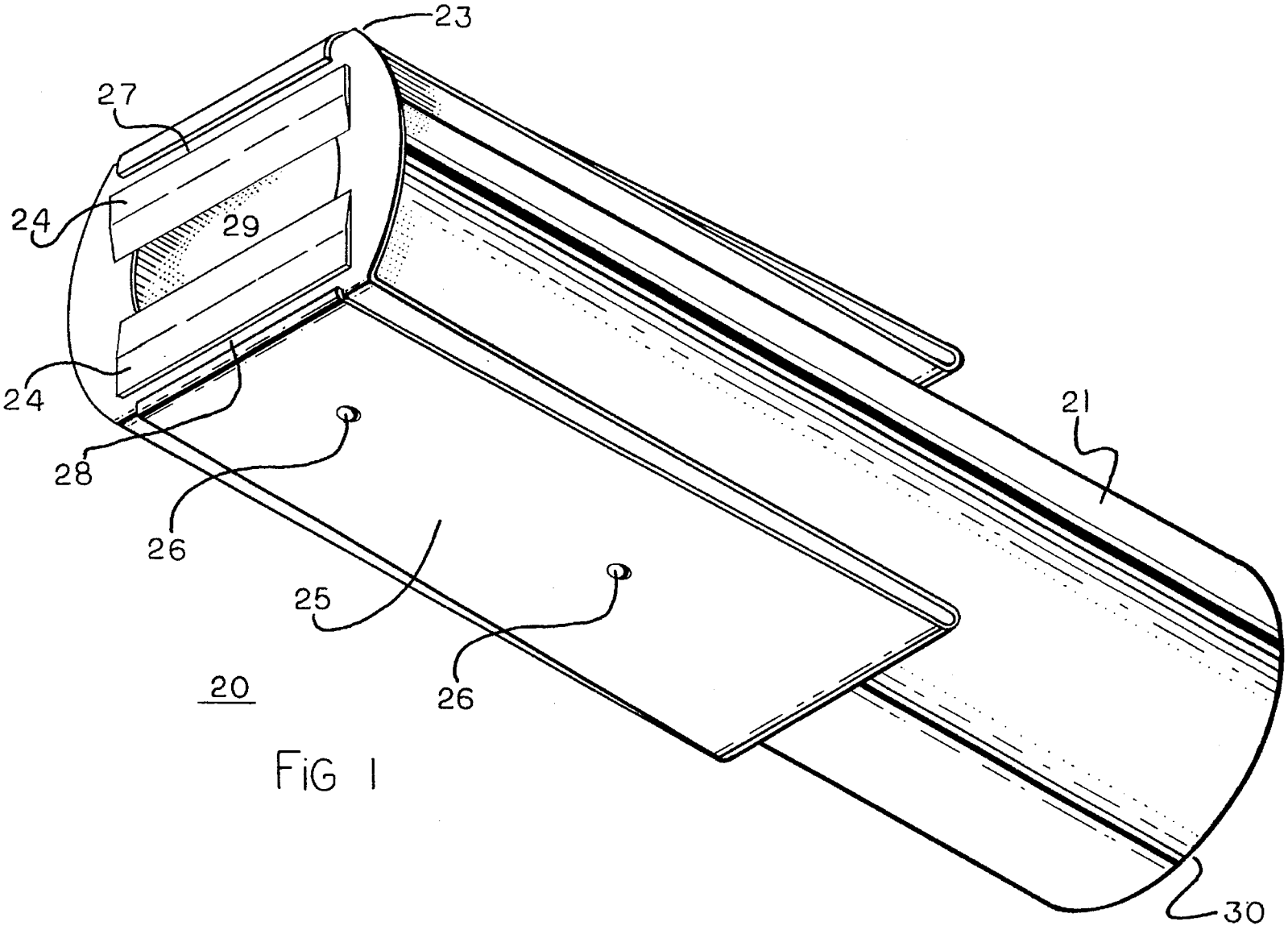
FIG. 1 is an enlarged perspective view illustrating a basic single element embodiment of the hand tool.

15. plurality of articles
16. bundle tie strap
19. strap head of 16
20. basic single element tool
20B. grooved face embodiment of single element tool
20F. beveled face embodiment of single element tool
20H. plain face slotted embodiment of single element tool
21. plain face carrier lever of tool 20
21B. grooved face carrier lever
21D. helix face carrier lever
21F. beveled face carrier lever
21H. plane face slotted carrier lever
21J. grooved face slotted carrier lever
21K. beveled face slotted carrier lever
22. strap tail of 16
23. cutter of 20 secured to front of carrier lever 21
23H. cutter of 20H secured to front of carrier lever 21H
24. pair of razor blade pieces of 23
25. brass holder of 20
26. common pins holding 25 to carrier lever of 20
27. fulcrum groove in cutter 23
28. alternate fulcrum groove in cutter 23
29. receiving port of 23
30. plain face of carrier lever 21
30B. grooved face of carrier lever 21B
31. stop head
32. levering groove in carrier lever 21B, 21J
33. extreme base edge of stop head 31
34. two lead helix on carrier lever 21D
35. side limit pieces of helix 34
36. flats on rear of carrier lever 21D
37. aperture in stop head 31
38. extreme base corner of stop head 31
39. base corner of stop head 31 diagonally opposite 38
40. beveled face closes to cutter 23
41. beveled face of carrier lever 21F, 21K furthest front end most parallel to cutter 23
42. peak formed by intersection of faces 40 and 41
43. bore of single element tool
44. slot in side of carrier levers 21H, 21J, 21K
45. radius at intersection of face 41 and slot 44 on carrier lever 21K
50. three element embodiment of tool
51. cutter wheel assembly of 50
52. wooden center disk of 51
53. front brass disk of 51
54. rear brass disk of 51
55. pins holding 56
56. ratchet strip of 51
57. "bow tie" shaped opening of front brass disk 53
58. drive flange of front brass disk 53 projecting rearward within 57
59. drive flange parallel and diagonally opposite 58
60. brass reinforcing angle backing 58
61. brass reinforcing angle backing 59
62. brass guide angle adjacent drive flange 58
63. brass guide angle adjacent drive flange 59
64. razor blade piece soldered to front of brass disk 53 parallel 58
65. razor blade piece soldered to front of brass disk 53 parallel 59
66. notches of ratchet strip 56
70. carrier assembly of 50
71. ratchet pawls of 70
73. finger of ratchet 71
74. seat for 71 in 75
75. carrier ring of 70
76. cover ring of 70
77. internally threaded acrylic plastic cylinder of 70
78. internal threads of 77
80. stop assembly of 50
81. barrel portion of 80
82. external threads of 81
83. hole of barrel portion 81
84. shaped head from 19 with base forward within 81
85. shaped head from 19 with base forward and pawl finger 73 180° to 84
86. matching lengthwise grooves spaced at 90° around 84 and 85
87. base opening of shaped head 85
88. base opening of shaped head 84
89. pins holding 84 and 85 within barrel portion 81

DESCRIPTION OF THE PREFERRED EMBODIMENTS

Turning now to FIGS. 1 through 11, details of seven single element embodiments of bundle tie tightening and cut off tool 20 are shown. Tool 20 is of generally cylindrical configuration with elongated carrier lever 21 having an inside bore 43 to loosely accommodate a strap tail 22. Tool 20 embodies a fixed cutter 23 at the front of carrier lever 21. Cutter 23 having an elongated receiving port 29 is joined to carrier 21 by brass holder 25. In the example illustrated, cutter 23 is formed by a pair of razor blade pieces 24 soldered to brass holder 25. Brass holder 25 is secured to rigid plastic carrier 21 by means of two common pins per side. All movement between holder 25 razor blade pieces 24, and carrier lever 21 is thus prevented thereby forming one integral unit. On cutter 23, fulcrum groove 27 and alternate fulcrum groove 28 are formed parallel to strap cutter receiving port 29 by fashioning razor blade pieces 24 and holder 25. Fulcrum groove 27 and alternate fulcrum groove 28 are thus located individually at a distance from the center of receiving port 29 appropriate to the size of strap head 19 against which it will bear. Best shown in FIG. 1, alternate fulcrum groove 28 could better fit a larger size of strap head 19 than fulcrum groove 27. Shown in FIG. 1 and FIG. 2, the rear of carrier lever 21 opposite cutter 23 may terminate in a plain face 30 parallel to cutter 23. Shown in FIG. 3, a stop head 31 bears on plain face 30.

Figure 5:
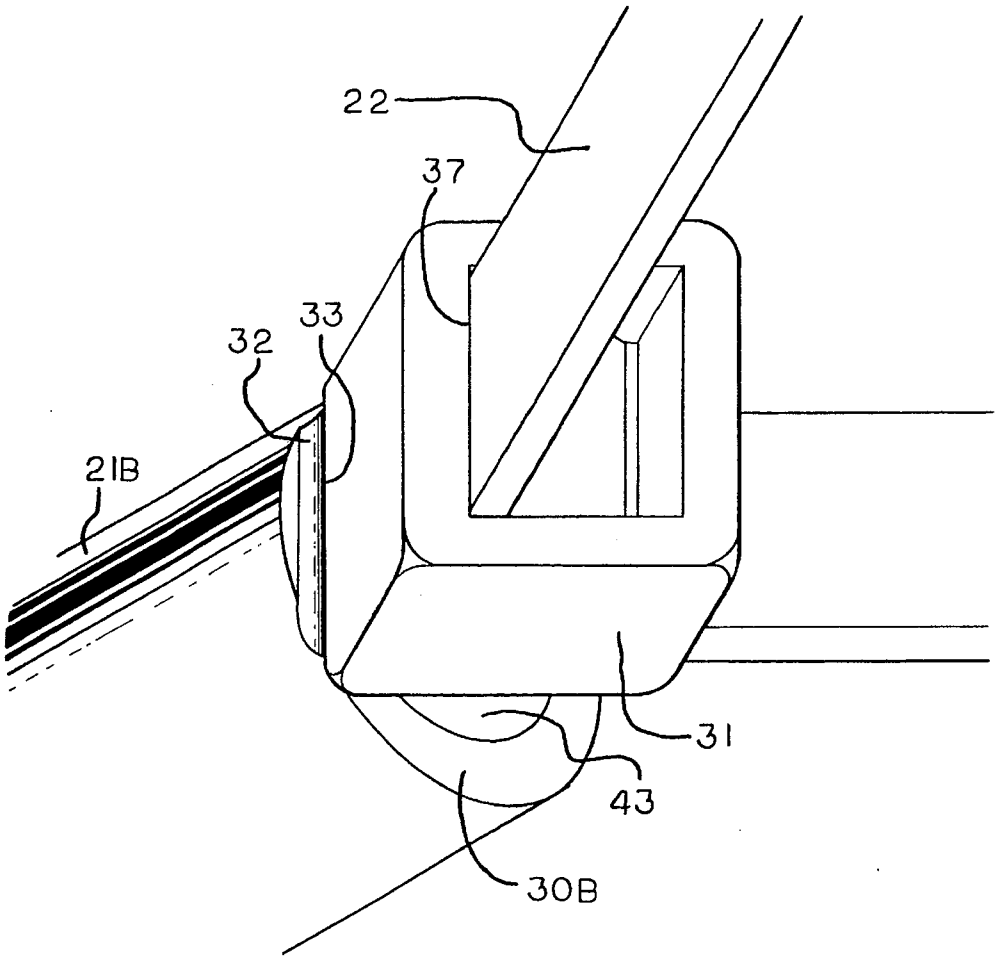
FIG. 5 shows the levered position of the stop head with respect to the groove of FIG. 4.
Figure 4:
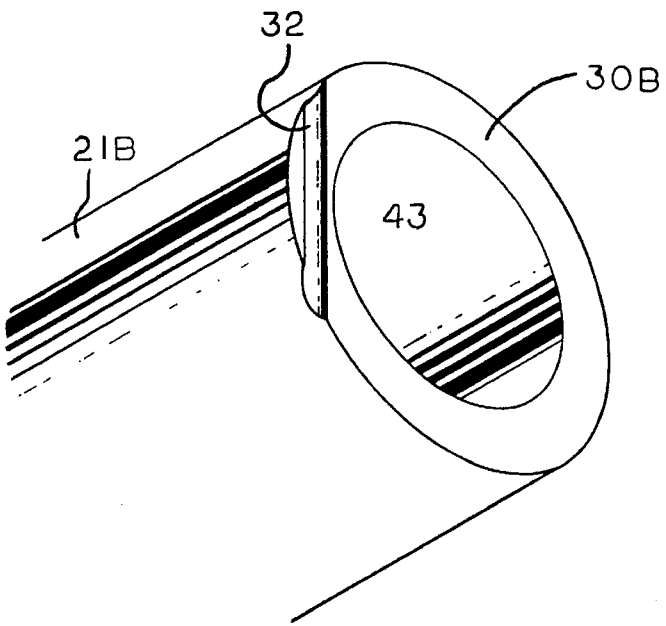
FIG. 4 shows a grooved modification to the rear of the tool of FIG. 1.

FIG. 4 and FIG. 5 show an alternative to plain face 30 wherein grooved face 30B, having levering groove 32, accepts the extreme base edge 33 of stop head 31 on the levered position. Groove 32 may be formed on either or both sides of bore 43 but should be parallel to strap cutter receiving port 29.

Figure 7:
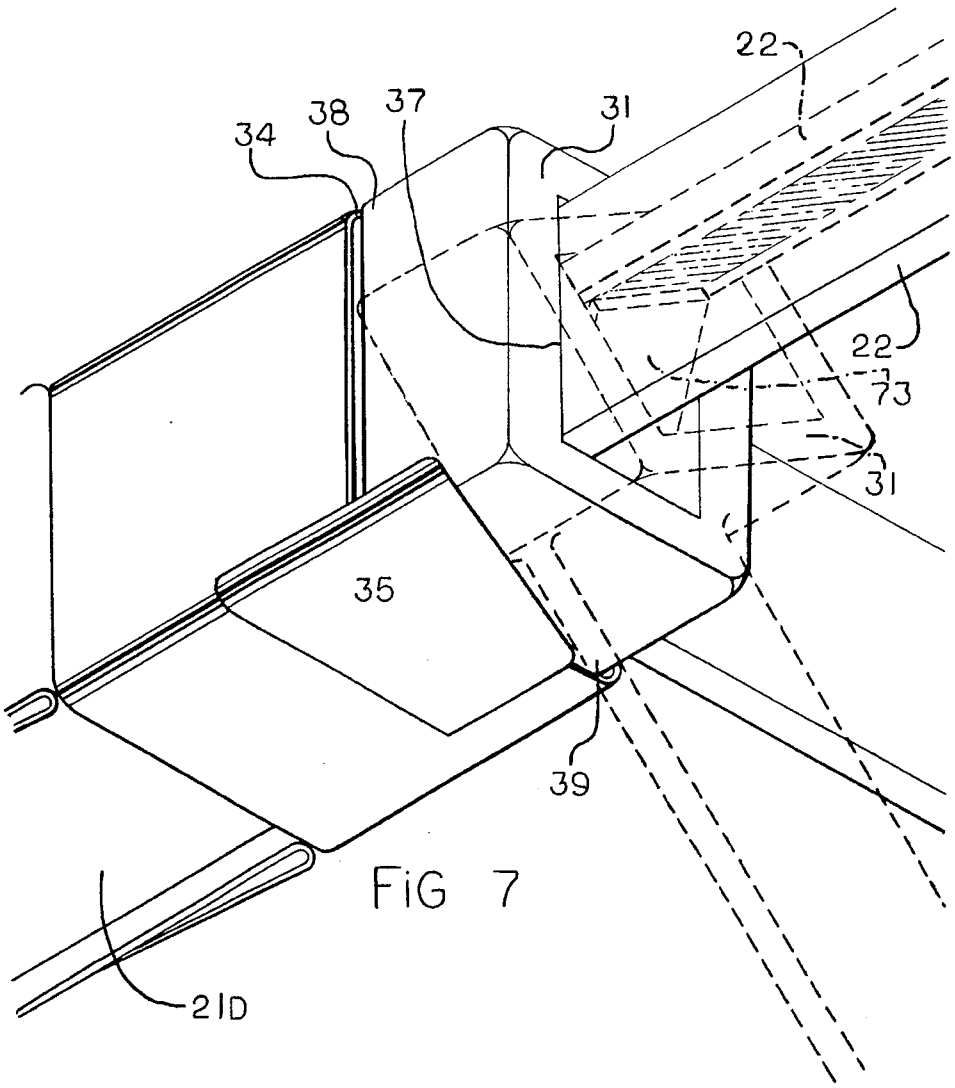
FIG. 7 shows the loose and tensioned positions of the stop head with respect to the helix of FIG. 6.
Figure 6:
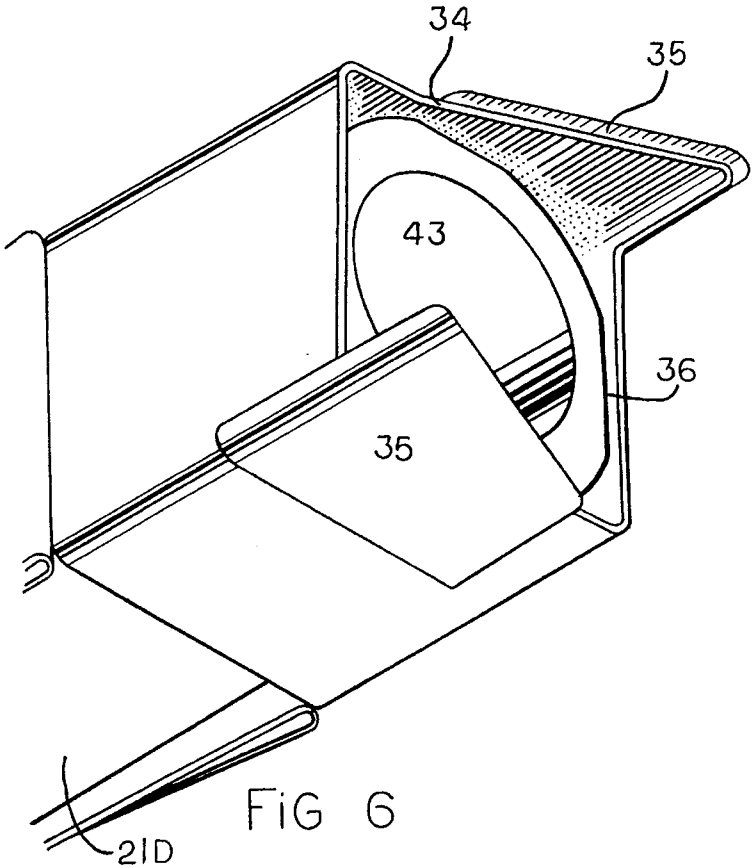
FIG. 6 shows a two lead helix modification to the rear of the tool of FIG. 1.

FIG. 6 and FIG. 7 show another alternative to plain face 30 having a quarter turn two lead helix 34 incorporating two side limit pieces 35. In the example illustrated, helix 34 is fitted removably by filing four opposing flats 36 on the rear of carrier lever 21D. Aperture 37 in stop head 31, shown by solid lines in FIG. 7, aligns initially with strap cutter receiving port 29. Shown in FIG. 7, helix 34 closely conforms to stop head 31 shown by solid lines in the initial loose position. In FIG. 7, the opposing base corners 38 and 39 of stop head 31 bear on the margins of helix 34 and are restrained laterally by side limit pieces 35 throughout the rotation of stop head 31 to the tensioned position shown by dashed lines. A helix which tensions with clockwise rotation of stop head 31 as viewed from the rear is felt most natural.

Figure 8A:
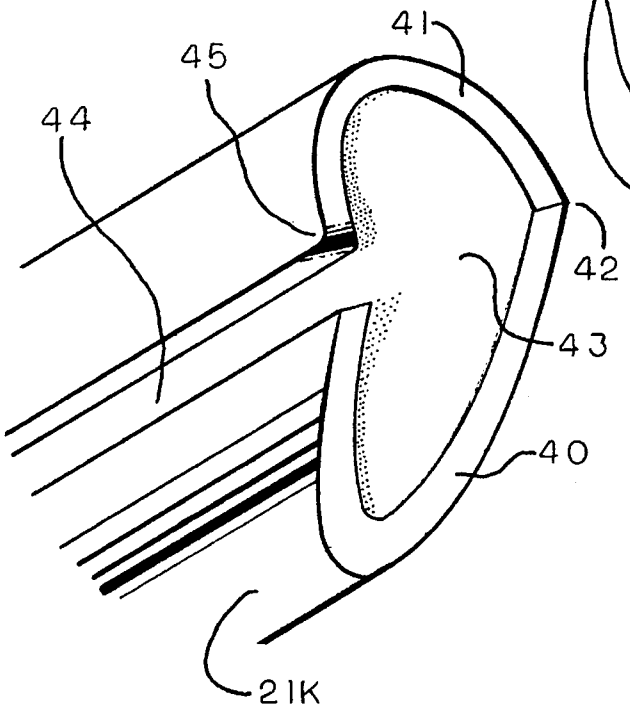
FIG. 8A shows a slotted modification of the tool of FIG. 8.
Figure 2:
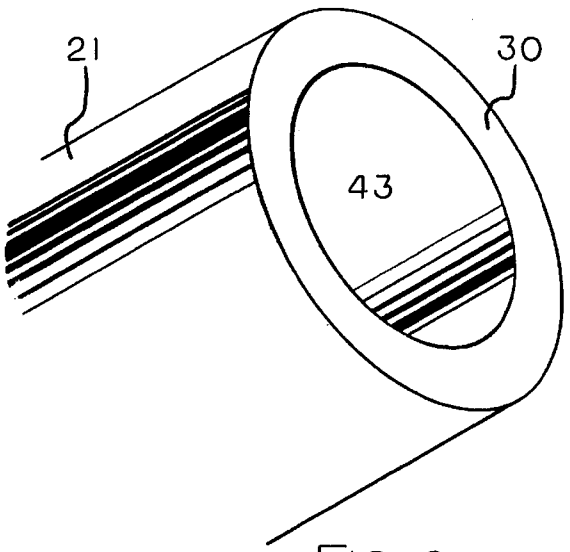
FIG. 2 is a fragmentary view of the rear of the tool of FIG. 1.
Figure 9:
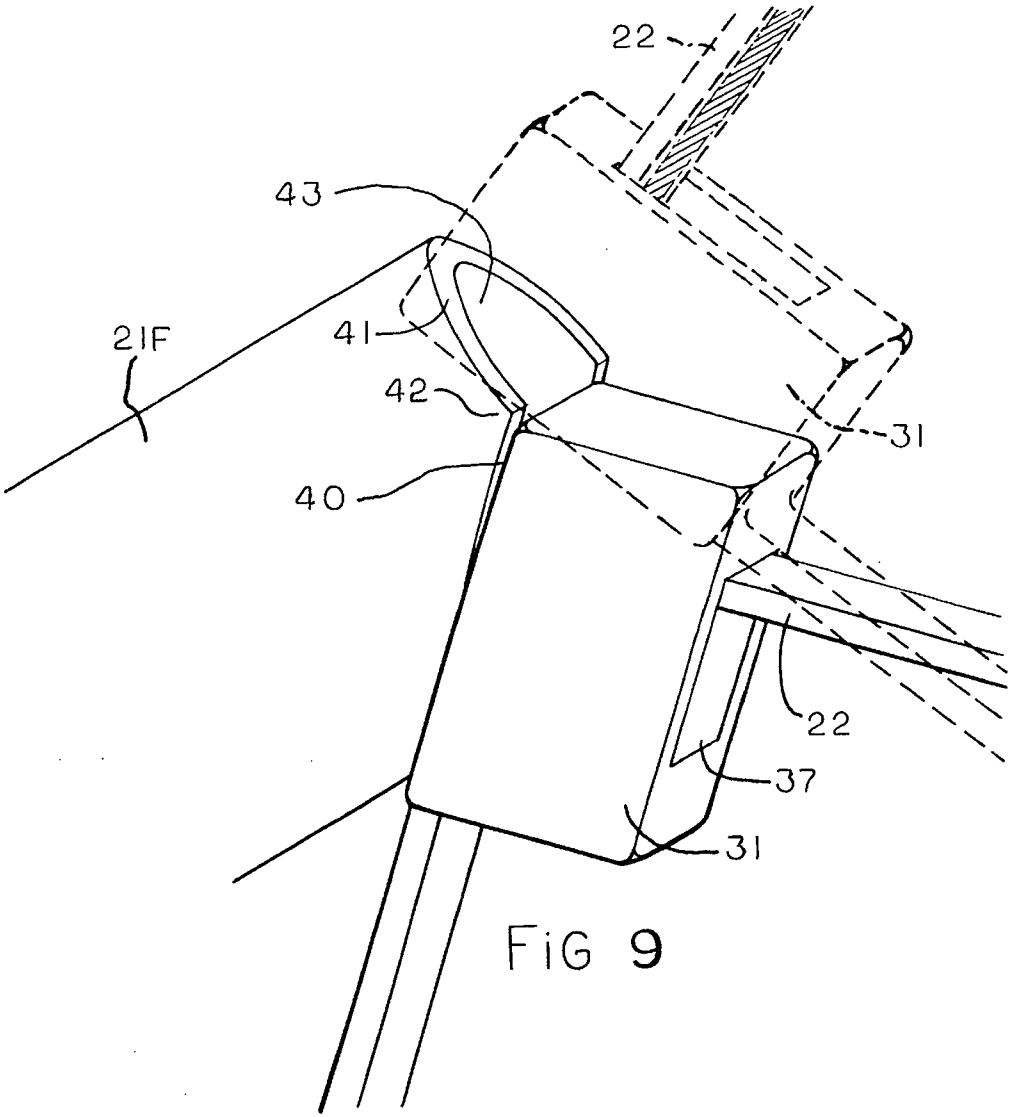
FIG. 9 shows the stop head in the loose and tensioned positions with respect to the beveled faces of FIG. 8.
Figure 8:
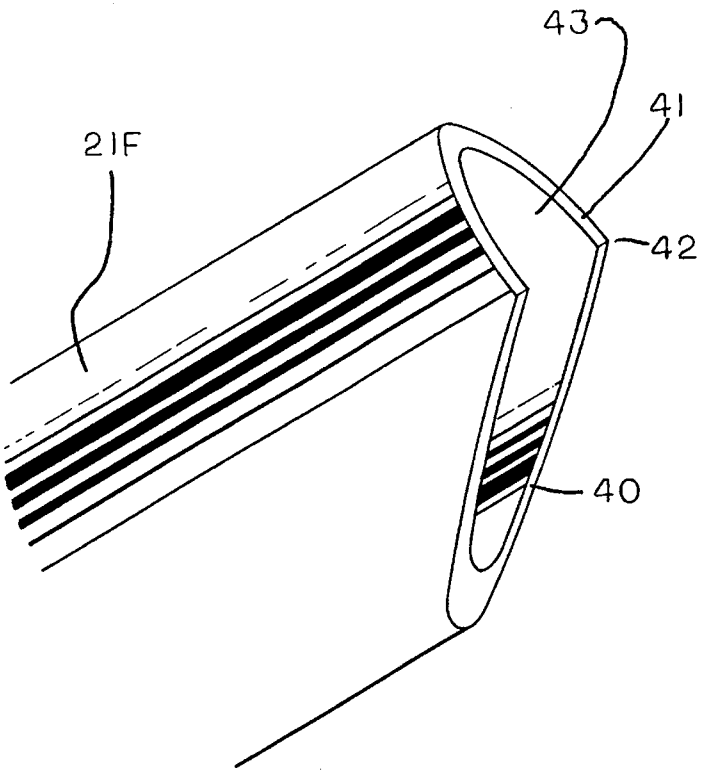
FIG. 8 shows a two faced beveled modification to the rear of the tool of FIG. 1.

In FIG. 8 and FIG. 9, a further alternative to plain face 30 of FIG. 2 is shown. A pair of beveled faces 40 and 41 intersect forming peak 42 parallel to cutter receiving port 29. Beveled face 40 is cut such that its area is substantially forward of beveled face 41. In FIG. 9, stop head 31 in the loose position shown by solid lines bears on face 40 and in the tensioned position shown by dashed lines bears on face 41. Face 41 is much more closely parallel cutter 23 than is face 40.

Figure 1A:
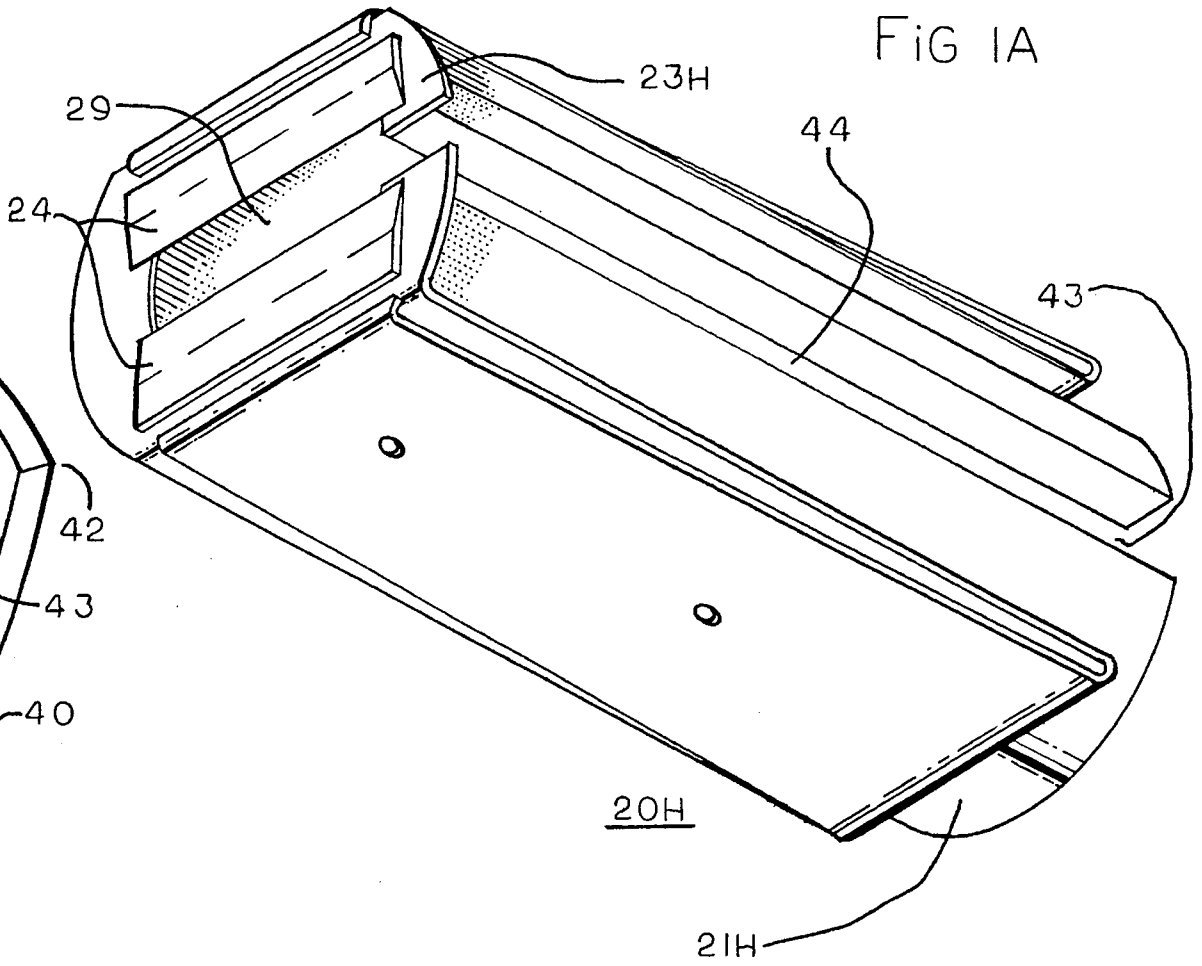
FIG. 1A shows a slotted embodiment of the tool of FIG. 1.

Shown in FIG. 1A, a further embodiment 20H of the single element tool may be seen wherein receiving port 29 and the exit of bore 43 are joined by cutting a slot 44 radially through one side of carrier lever 21H and cutter 23H between razor blade pieces 24.

Figure 4A:
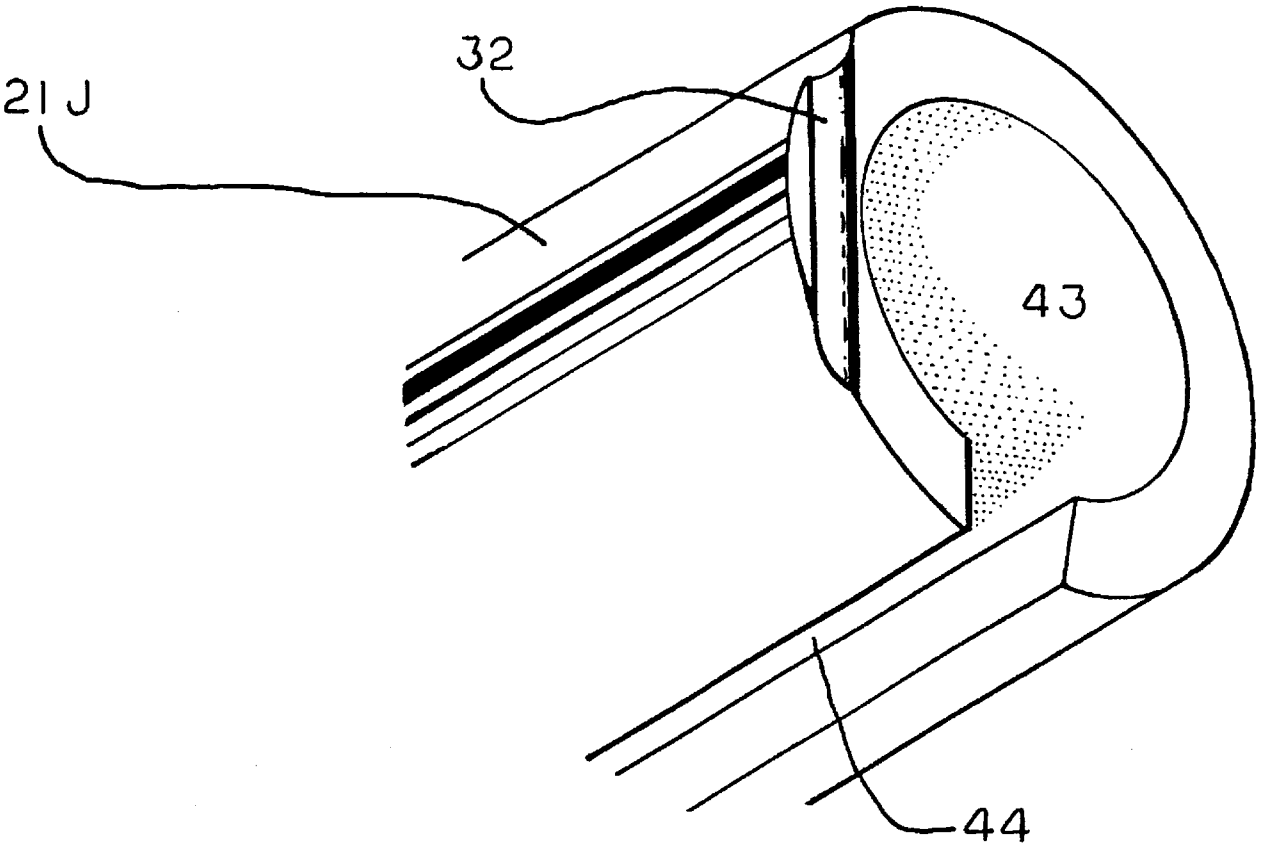
FIG. 4A shows a slotted modification of the tool of FIG. 1.

As shown in FIG. 4A, slot 44 may be incorporated with groove 32 to form grooved face slotted carrier 21J.

As shown in FIG. 8A, slot 44 may be incorporated with beveled faces 40 and 41 to form beveled face slotted carrier lever 21K. A radius 45 is formed along the intersection of beveled face 41 and slot 44.

Figure 17:
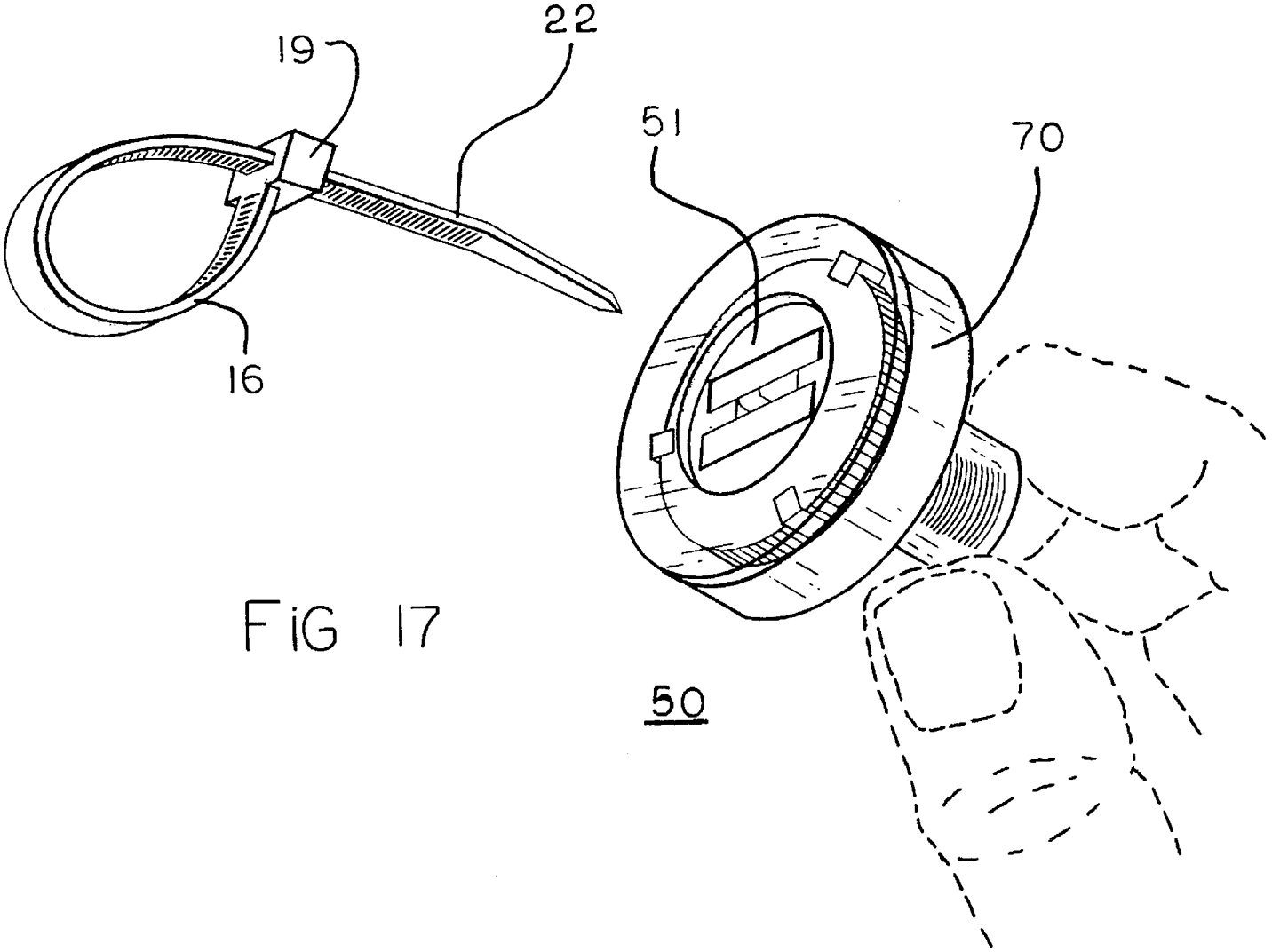
FIG. 17 is a perspective view illustrating the holding of a three element embodiment of the hand tool.
Figure 18:
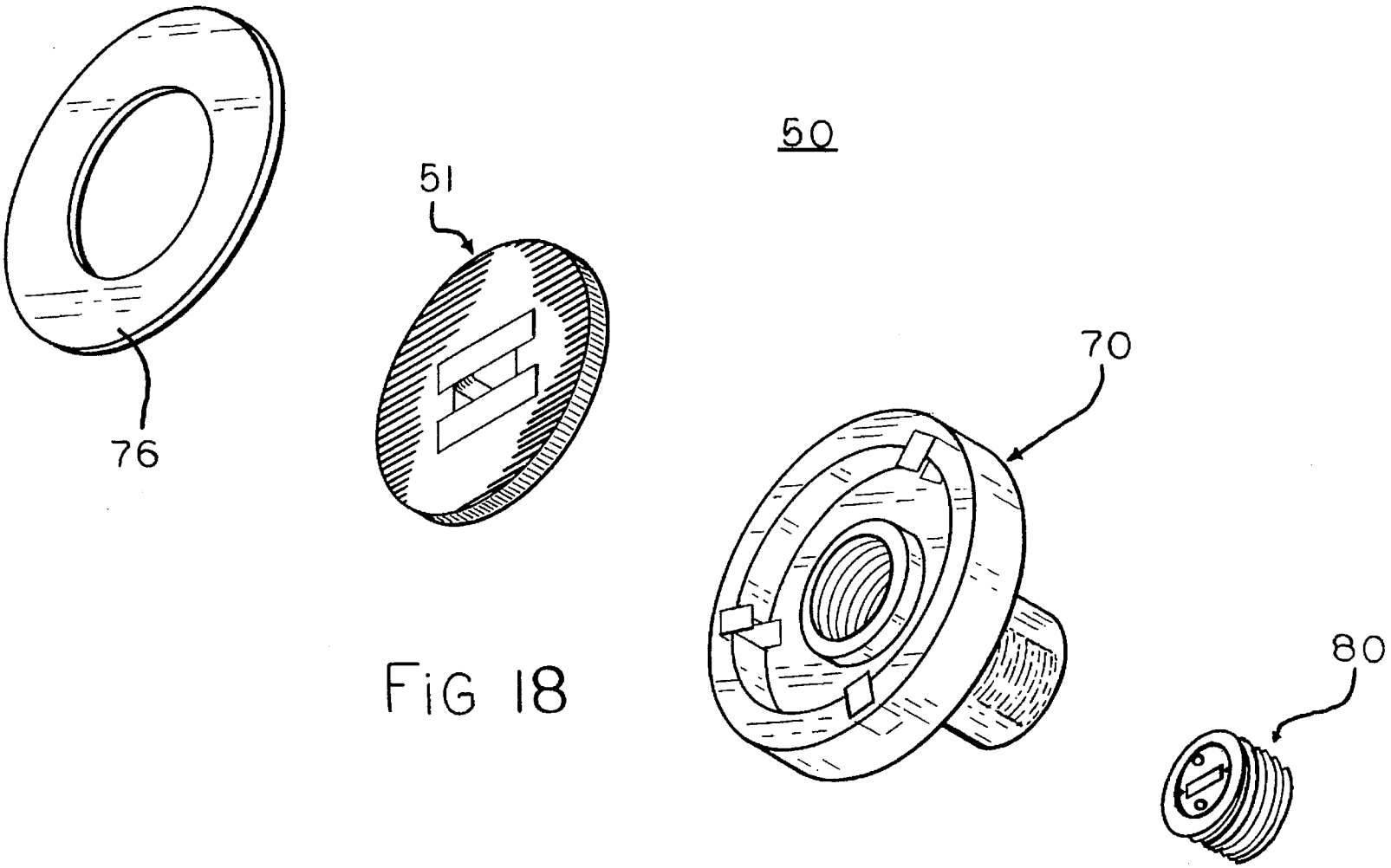
FIG. 18 is an exploded perspective view of the hand tool of FIG. 17 showing the cutter wheel assembly, carrier assembly and stop assembly.
Figure 19:
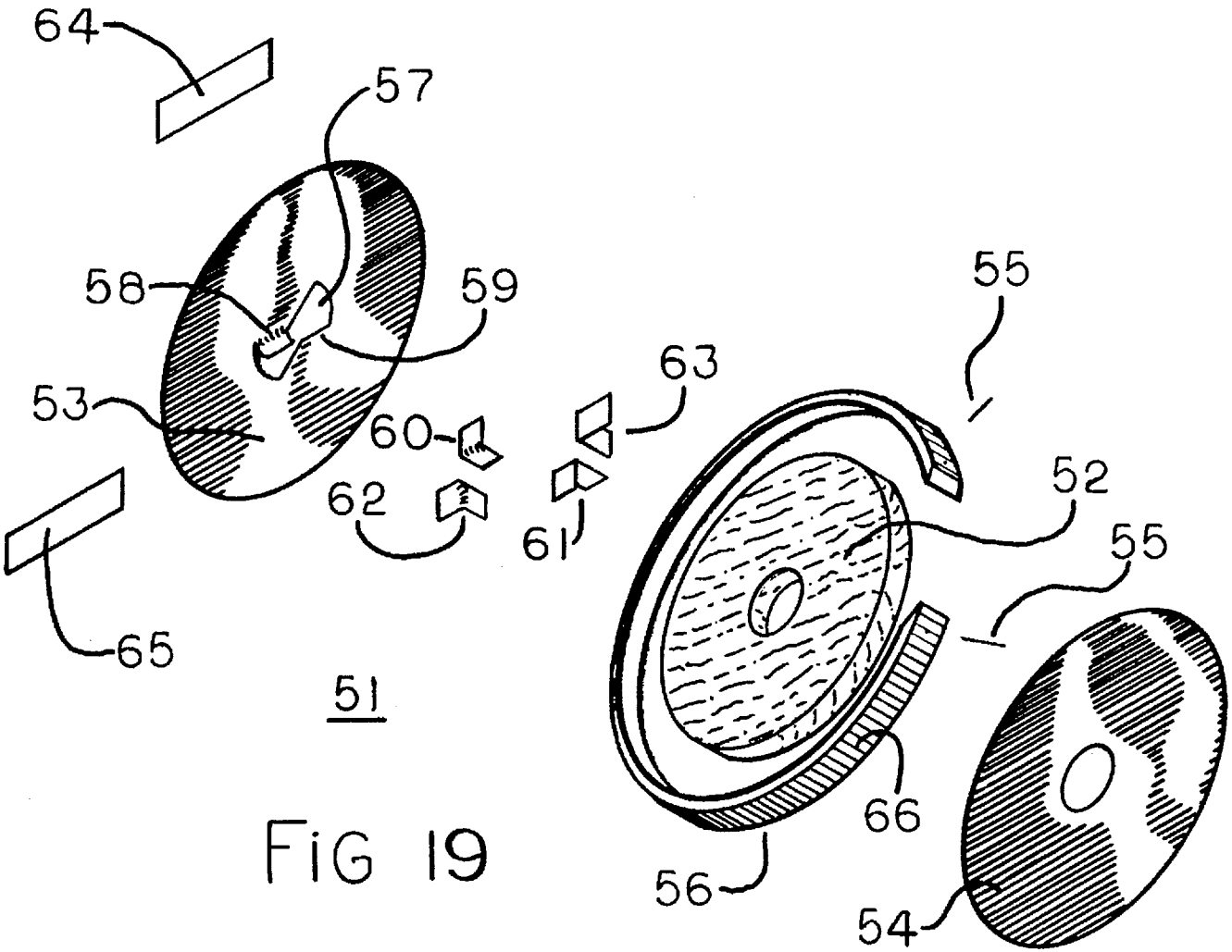
FIG. 19 is an exploded perspective view of the cutter wheel assembly of FIG. 18
Figure 21:
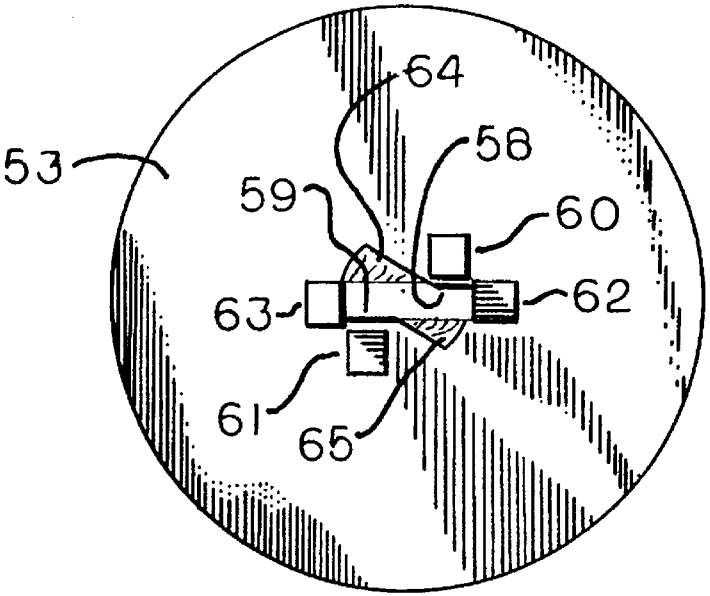
FIG. 21 is an enlarged rear view of the front disk of the cutter wheel assembly of FIG. 19.
Figure 20:
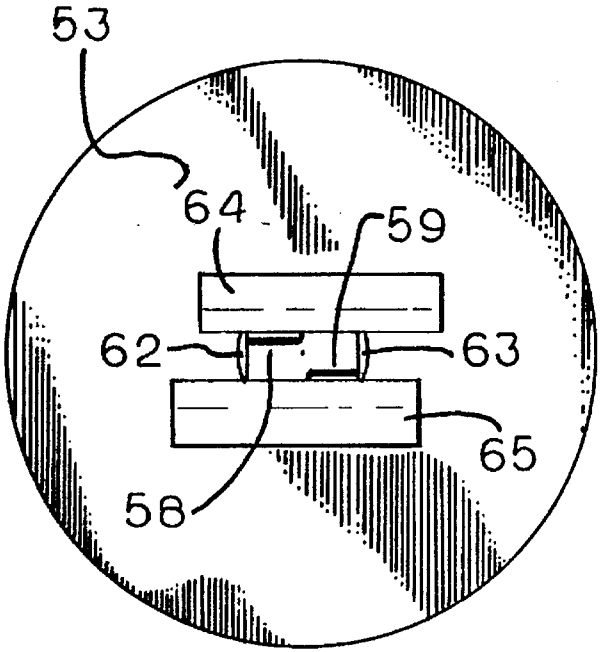
FIG. 20 is an enlarged front view of the front disk of the cutter wheel assembly of FIG. 19.
Figure 22:
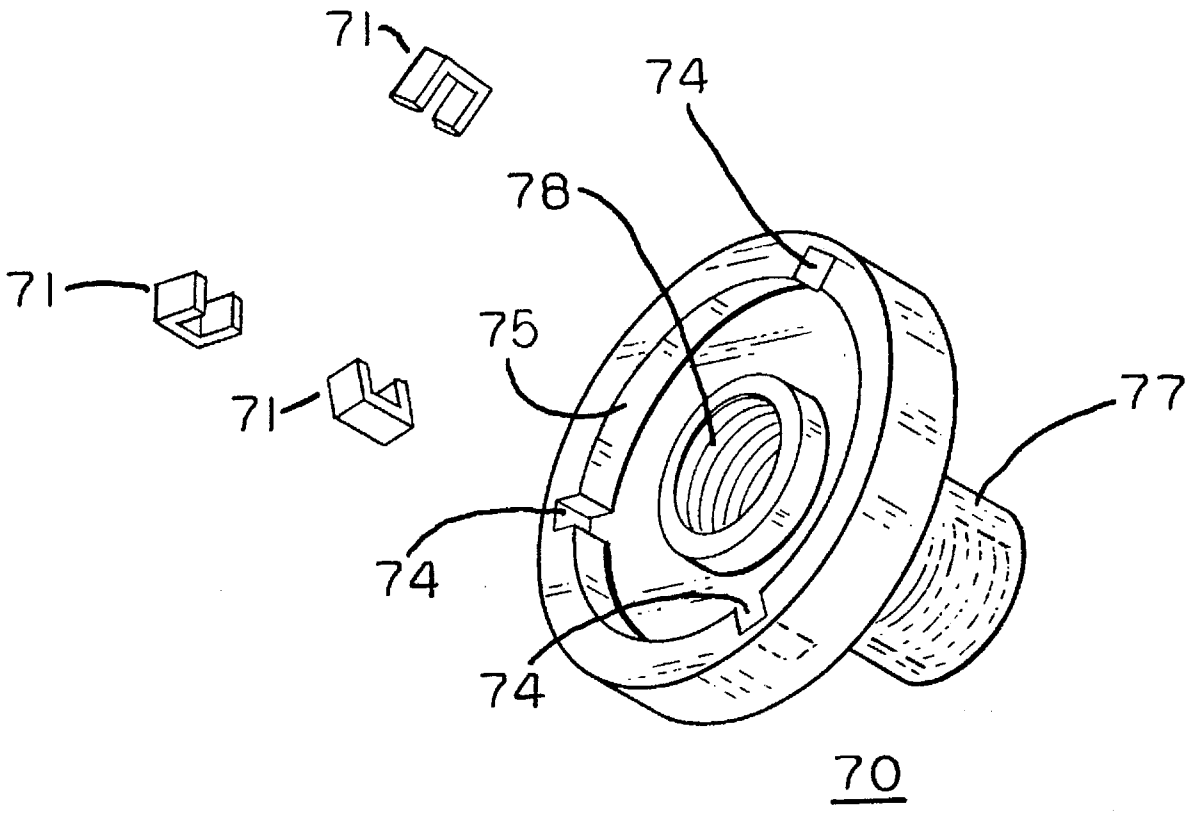
FIG. 22 is an exploded perspective view of the carrier assembly of FIG. 18 with the cover ring omitted.
Figure 23:
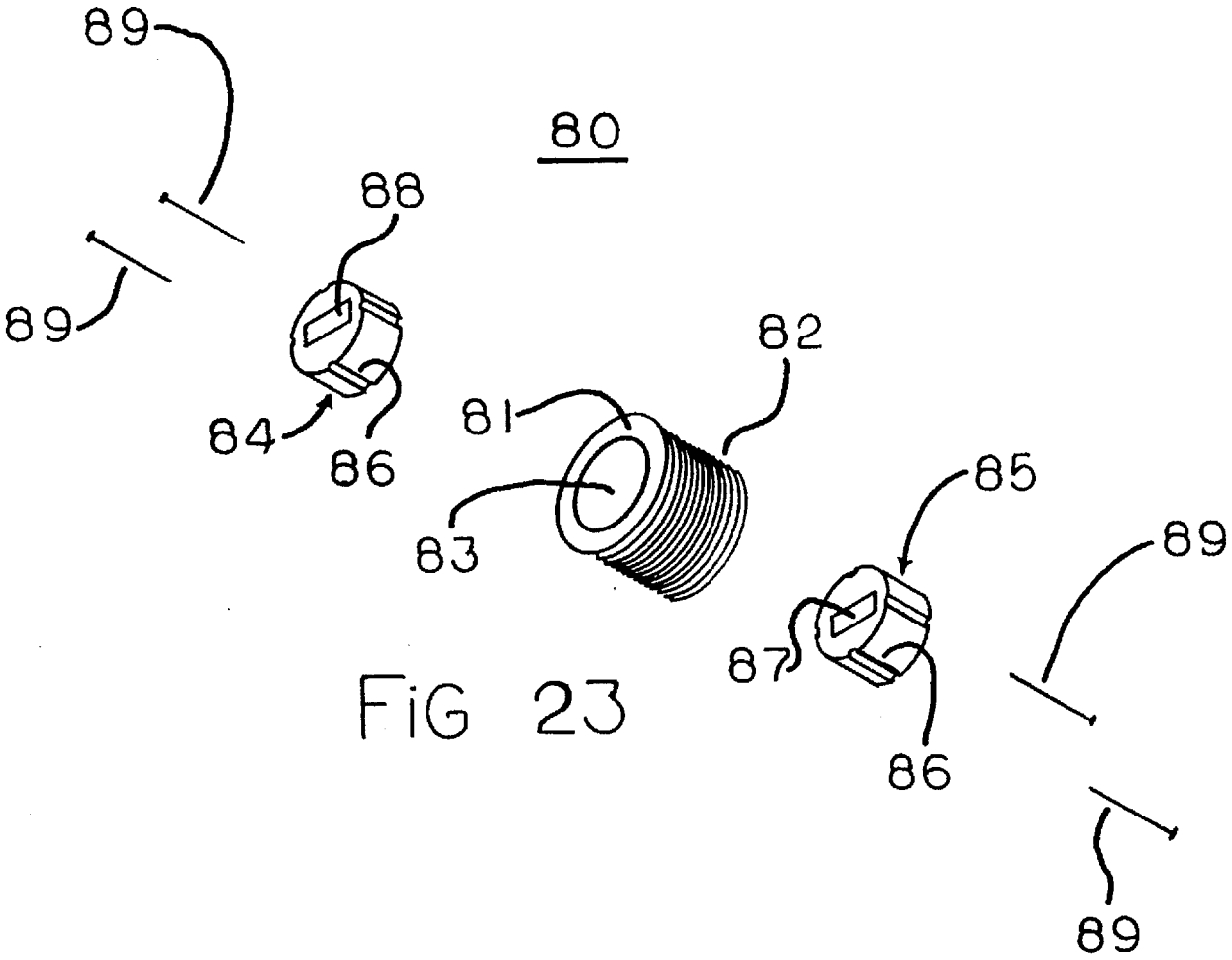
FIG. 23 is an exploded perspective view of the stop assembly of FIG. 18.

Turning now to FIGS. 17 through 23, a three element embodiment of the bundle tie tightening and cut off tool 50 is shown. FIG. 17 shows tool 50 configured as a thick disk with a cylinder emerging from its rear surface axially. As shown in FIG. 18, tool 50 is comprised of three assemblies: cutter wheel assembly 51, carrier assembly 70 and stop assembly 80. As shown in FIG. 19, cutter wheel assembly 51 has a wooden center disk 52 glued between two brass disks 53 and 54. Wooden center disk 52 and rear brass disk 54 have at their centers a hole of sufficient diameter to loosely accommodate strap tail 22. Secured around the circumference of wooden center disk 52 with pins 55 is a ratchet strip 56 formed by trimming the ends and side margins from a self-locking strap 16. Notches 66 of ratchet strip 56 protrude from between disk 53 and 54. At the center of front brass disk 53 is a "bow tie" shaped opening 57 incorporating two drive flanges 58 and 59 which protrude from the rear surface and into the hole of wooden center disk 52. As shown in FIGS. 20 and 21, drive flanges 58 and 59 are spaced to contact and parallel the opposite surfaces of an inserted strap tail 22 at diagonal extremes of opening 57. The diagonal extremes chosen must correspond to urging ratchet strip 56 to rotate in the free direction. A counter clockwise free rotation of cutter wheel assembly 51 within carrier assembly 70 viewed from the rear is felt to be most natural. Drive flanges 58 and 59 are strengthened, in the example illustrated, by soldering brass reinforcing angles 60 and 61 to the rear surface of disk 53 as backing. Brass guide angles 62 and 63 are soldered to the rear surface of disk 53 perpendicular to drive flanges 58 and 59 spaced so as to loosely accommodate and center strap tail 22 within "bow tie" shaped opening 57. Also shown in FIGS. 20 and 21, two razor blade pieces 64 and 65 are soldered to the front surface of disk 53 with their cutting edges parallel to, but set back slightly from, drive flanges 58 and 59. As shown in FIG. 22, carrier assembly 70 is formed, except for three ratchet pawls 71, by cementing acrylic plastic rings axially to an internally threaded acrylic plastic cylinder 77. Each ratchet pawl 71 is formed by removing the tail 22 from a self-locking strap 16. The strap head 19 is then opened enough to accommodate cutter wheel assembly 51 by removing a section of the head opposite the pawl finger 73. Pawl finger 73 is best shown in FIG. 7. While straddling the cutter wheel assembly 51, ratchet pawls 71 are individually held in three seats 74 evenly spaced within carrier ring 75. Ratchet pawls 71 are seated so as to allow rotation of carrier assembly 70 about cutter wheel assembly 51 in the free direction only. As shown in FIG. 18, cover ring 76 is cemented to carrier ring 75, thereby securing ratchet pawls 71 in seats 74. Cutter wheel assembly 51 straddled by ratchet pawls 71 is thus retained within carrier assembly 70. Internally threaded cylinder 77 is mounted axially within carrier ring 75 and bears on the rear surface of cutter wheel assembly 51. Internal threads 78 of cylinder 77 are cut so as to carry rearward when carrier assembly 70 is rotated in the free direction with respect to cutter wheel assembly 51. As shown in FIGS. 18, 22 and 23 stop assembly 80 having external threads 82 on barrel portion 81 is carried loosely within cylinder 77 by threads 78. As shown in FIG. 23, barrel portion 81 has a lengthwise through drilled hole 83 to snugly accommodate two shaped heads 84 and 85. Heads 84 and 85 are formed by rounding two strap heads 19 to a cylindrical shape centered about their base openings 88 and 87. Within hole 83, heads 84 and 85 are stacked with base openings 88 and 87 forward and pawl fingers 73 180° apart. Stacked heads 84 and 85 are provided with four matching lengthwise grooves 86 spaced evenly along their outer surface. Heads 84 and 85 are held in alignment within hole 83 by inserting two pins 89 from each end of barrel portion 81 down the full length of grooves 86. All four pins 89 are then soldered to barrel portion 81 thereby securing shaped heads 84 and 85 within stop assembly 80.

Single Element Tool—Operation

Figure 3:
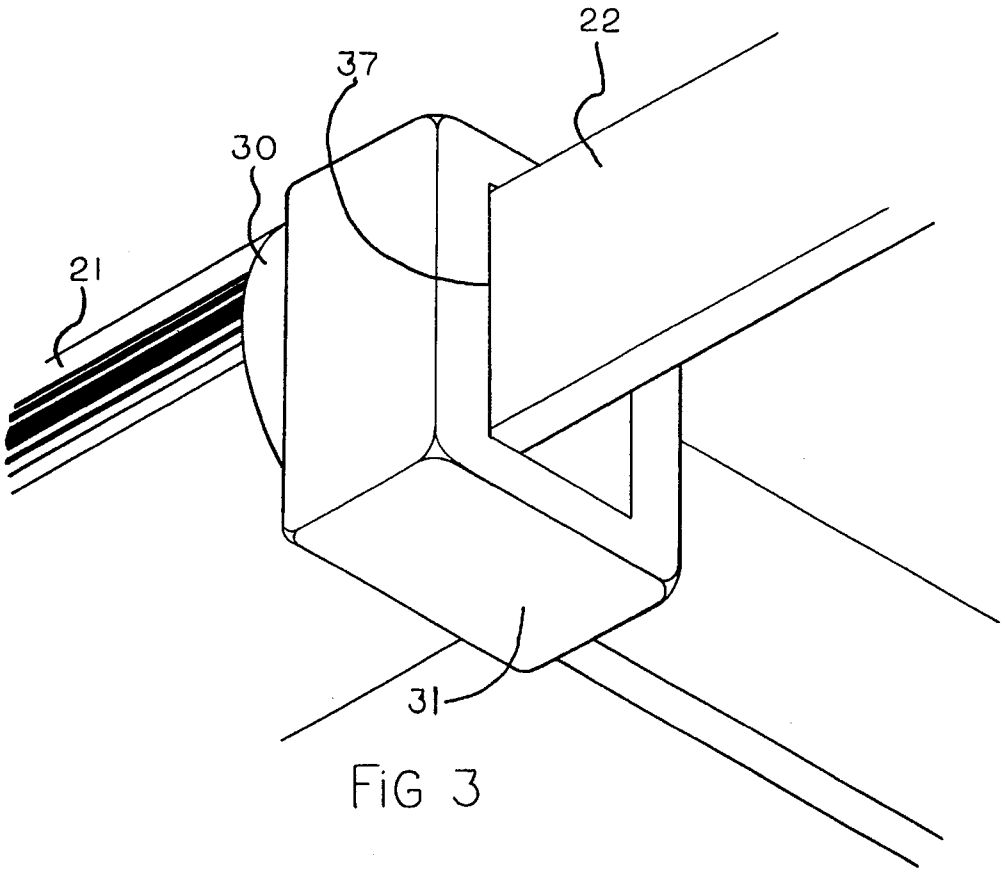
FIG. 3 shows the initial position of a strap head with respect to the rear of the tool of FIG. 1.
Figure 11:
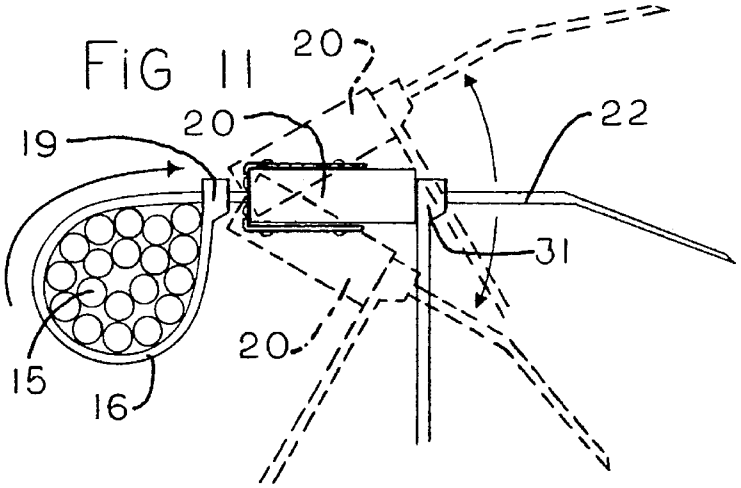
FIG. 11 shows the rocking motion of the tool of FIG. 10 tightening a strap around a bundle of articles.
Figure 10:
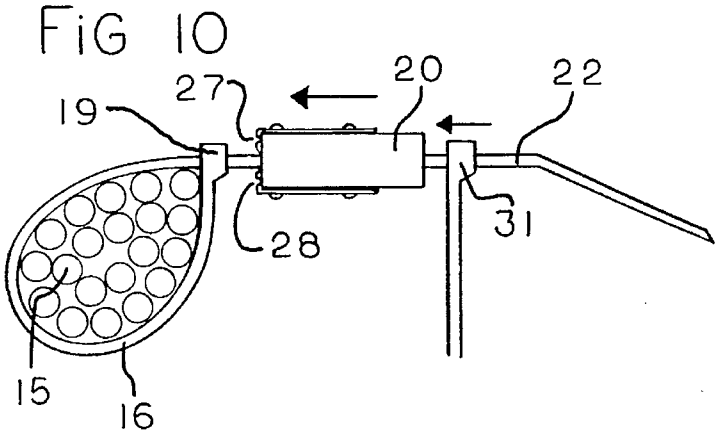
FIG. 10 is a side elevational view of the tool of FIG. 1 in its initial condition with the free tail end portion of a looped strap introduced into the tool and through the head of another strap.
Figure 12:
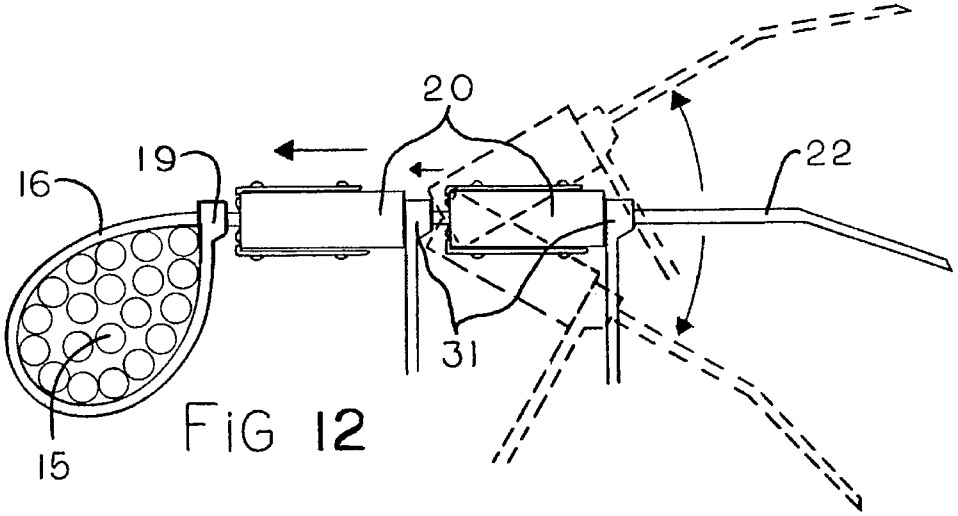
FIG. 12 shows the rocking motion in FIG. 11 being applied by a second like tool and stop head thereby urging the first tool and stop head forward.

Turning now to FIGS. 1, 2, 3, 10, 11, and 12, the operation of single element tool 20 of FIG. 1 is summarized up to the excess strap trimming step. A self-locking bundle tie strap 16 having a strap head 19 and a strap tail 22 is looped about a plurality of articles 15 to be formed into a bundle. The loop is formed by threading tail 22 of strap 16 through an aperture in head 19. Also located in head 19 is a one-way locking device (not shown) which will permit strap 16 to be drawn up on articles 15 but prevent the loop from being opened by a force applied to strap 16. Protruding from head 19, tail 22 is pulled up to a hand tight condition and then inserted through strap cutter receiving port 29, bore 43 of carrier lever 21, and stop head 31 of a second like strap 16. As shown in FIG. 10, stop head 3 and tool 20 are slid forward along strap tail 22. As shown in FIG. 3, stop head 31 bears on plain face 30. FIG. 2 best shows plain face 30 at the rear carrier lever 21 on tool 20. As shown in FIG. 10, fulcrum groove 27 and alternate fulcrum groove 28 will be brought to bear on respective parallel edges of strap head 19 when stop head 31 is snugged by hand to its forward limit. Thus as shown in FIG. 11, tool 20 becomes a tightening lever using the rear face of strap head 19 as a fulcrum when rocked about said strap head 19 within the plane formed by the loop of strap 16 about articles 15. Also shown in FIG. 11, the rocking motion of tool 20 causes strap tail 22 to be pulled through strap head 19 drawing articles 15 closer together. The tightening efficiency of the single element tool requires the portion of strap tail 22 between strap head 19 and stop head 31 to be held in tension throughout the rocking motion of the tool. Successive strap tightening steps may be accomplished by resnugging stop head 31 to its forward limit as shown in FIG. 10 and then repeating the rocking motion of tool 20 shown in FIG. 11. By resistance to the rocking motion of FIG. 11, the operator will determine the point at which sufficient tightening of strap 16 about articles 15 has been reached. Owing to slight variations in style and size of head 19, the rocking motion in FIG. 11 of tool 20 should be limited to employ either fulcrum groove 27 or alternate fulcrum groove 28 shown in FIG. 1, according to best fit. The tightening efficiency of tool 20 will thereby improve. While cutting off or trimming the excess strap tail 22 from strap 16, the portion of strap tail 22 between strap head 19 and stop head 31 should be held in tension with tool 20 returned to the initial alignment shown by solid lines in FIG. 11. As shown in FIG. 12, said tensioning as well as additional strap tightening steps may be accomplished by ganging a second like tool 20 and stop head 31 behind the first. Said tension is required while cutting off or trimming excess strap tail 22 to produce a clean cut flush with head 19. Otherwise, there is a chance of an undesirable strap tail burr or knife like point protruding from strap head 19 at the completion of excess strap tail cut off operations.

Figure 13:
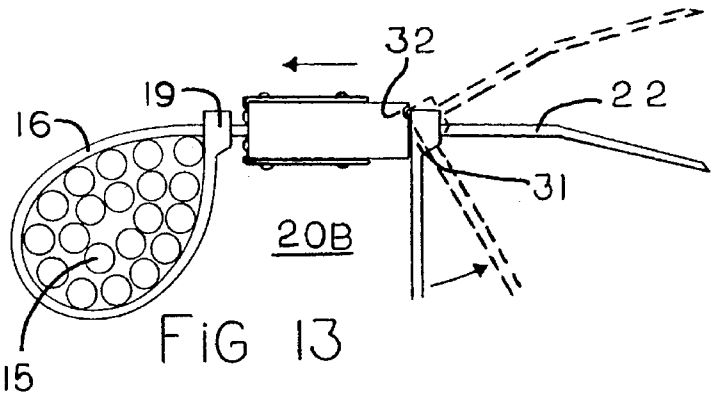
FIG. 13 is a side elevational view of the tool of FIG. 5 showing the levering motion of the stop head urging the tool forward along the free tail end portion of a looped strap.
Figure 15:
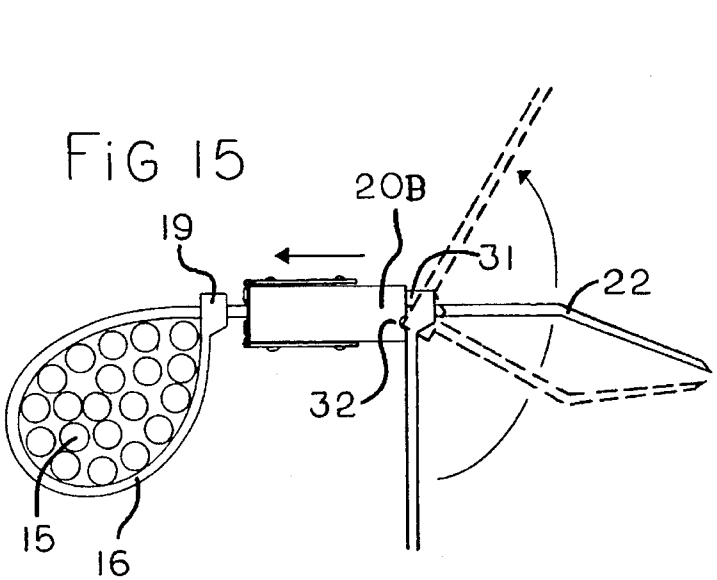
FIG. 15 shows an alternative arrangement of the tool of FIG. 13 in relation to the free tail portion of a looped strap.
Figure 14:
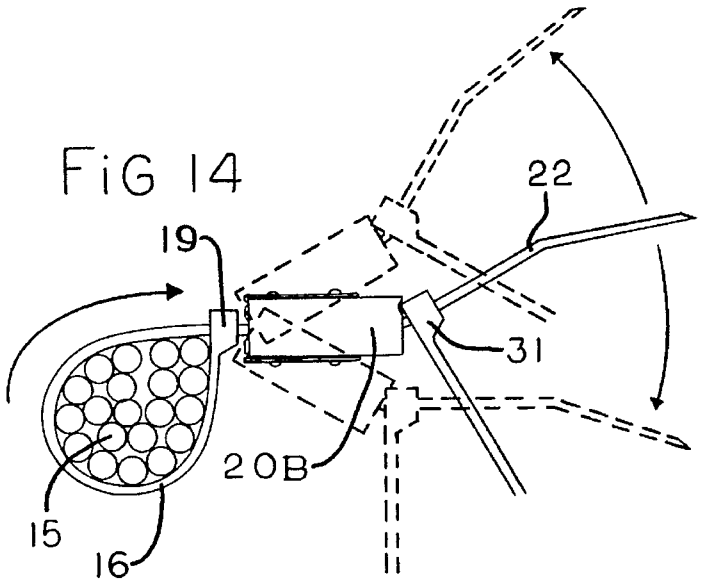
FIG. 14 shows the rocking motion of the tool of FIG. 13 applied with the stop head in the levered position tightening a strap around a bundle of articles.

Turning to FIGS. 4, 5, 13, 14, and 15, the operation of grooved face single element tool 20B up to the excess strap tail trimming step is shown. In FIG. 13, the levering of stop head 31 from it initial position shown by solid lines to its levered position shown by dashed lines tensions the portion of strap tail 22 between strap head 19 and stop head 31. Extreme base edge 33 of stop head 31 best shown in FIG. 5, pivots in levering groove 32 of tool 20B best shown in FIG. 4. As shown in FIG. 14, rocking tool 20B about strap head 19 with strap tail 22 tensioned by holding stop head 31 in the levered position of FIG. 13, pulls strap tail 22 through strap head 19 thereby tightening strap 16 about articles 15. Successive tensioning steps and tightening steps may be accomplished by returning stop head 31 to the initial position shown by solid lines in FIG. 13, snugging by hand to the forward limit, then again levering stop head 31 to the position shown by dashed lines and rocking tool 20B about strap head 19. An alternative method of tensioning strap tail 22 with grooved face single element tool 20B is shown in FIG. 15. Strap tail 22 is introduced to receiving port 29 such that levering groove 32 is on the opposite side of bore 43 from extreme base edge 33 of stop head 31. From the snugged initial position shown by solid lines in FIG. 15, stop head 31 is rotated about the longitudinal axis of tool 20B either clockwise or counterclockwise 180° and held in the levered position shown by dashed lines with extreme base edge 33 pivoting in levering groove 32. For installations where space permits, said rotation of stop head 31 will slightly increase the tension of strap tail 22 over simple levering of stop head 31. Turning to FIG. 6, 7 and 11, the operation of a single element tool having carrier lever 21D modified to incorporate a quarter turn two lead helix on its rear face is detailed up to the excess strap cut off step. As shown in FIG. 7 by solid lines, strap tail 22 is passed through carrier lever 21 D, two lead helix 34 best shown in FIG. 6, and stop head 31. In the initial loose position shown by solid lines in FIG. 7, stop head 31 is snugged by hand to its forward limit resting between the two leads of helix 34. In order to tension strap tail 22, stop head 31 is rotated clockwise up to one quarter turn with respect to helix 34 on the rear of carrier lever 21D. Opposing base corners 38 and 39 of stop head 31 bear on respective leads of helix 34 throughout said rotation, thereby carrying rearward to the tensioned position shown by dashed lines in FIG. 7. While bearing on leads of helix 34, opposing base corners 38 and 39 are restrained laterally from slipping off said leads by side limit pieces 35. The portion of strap tail 22 between strap head 19 and stop head 31 is thus tensioned prior to strap tightening and excess strap tail cut off steps. Strap tightening is accomplished as shown in FIG. 11 and previously described for single element tool 20 before the excess strap tail cut off step.

Figure 16:
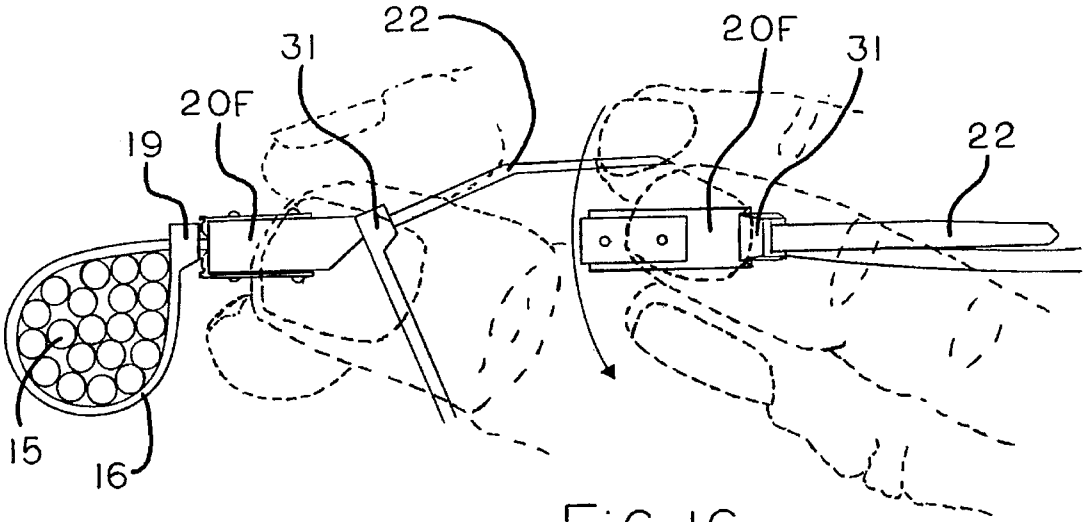
FIG. 16 is a sequence in side elevational view of the tool of FIG. 9 being used to cut off the excess strap tail.

Turning to FIGS. 8, 9 and 16, the operation of beveled faced single element tool 20F is shown. Strap tail 22 is passed through receiving port 29, carrier lever 21 F, and stop head 31. In FIG. 9 as shown by solid lines, stop head 31 is snugged by hand to its initial loose position bearing on beveled face 40. In order to tension strap tail 22, stop head 31 is then slid rearward along beveled face 40, up and over peak 42 to bear on beveled face 41 reaching the position shown by dashed lines in FIG. 9. With strap tail 22 tensioned, stop head 31 will remain on beveled face 41 with little or no assistance because beveled face 41 is nearly perpendicular to bore 43 of tool 20F. The loose fit of strap tail 22 within bore 43 best shown in FIG. 8, readily accommodates strap tail 22 throughout said sliding motion of stop 31 from beveled face 40 to beveled face 41. With stop head 31 in the tensioned position shown by dashed lines in FIG. 9, strap 16 may be tightened in successive steps by rocking tool 20F about strap head 19 as previously described for other single element embodiments of the tool. When strap 16 is determined to be sufficiently tight about articles 15, excess strap tail 22 may be cut off. As noted above, the cut off operation is accomplished with strap tail 22 held in tension between strap head 19 and stop head 31. Shown in FIG. 16, excess strap tail 22 is cut off, as with the other single element embodiments, by rotating tool 20F clockwise or counterclockwise about its longitudinal axis normal to strap head 19. Thus either or both razor blade pieces 24 are brought into severing contact with excess strap tail 22.

Turning to FIGS. 1A, 4A and 8A, details of operation for three embodiments of the slotted single element tool are given. In use, the incorporation of slot 44 with carrier levers 21H, 21J and 21K provides the operator with the additional options of placing or removing the single element tool on strap tail 22 while stop head 31 is in its loose or initial position. With the cutter of the tool forward, strap tail 22 may be introduced to bore 43 by aligning slot 44 with the left or right side of strap tail 22 between strap head 19 and stop head 31 then moving the slotted single element tool latterly to the initial position. Removal of the slotted single element tool from strap tail 22 is by lateral movement in the opposite direction such that strap tail 22 emerges through slot 44. Tensioning, tightening, and cut off steps are accomplished as with the other single element embodiments. As shown in FIG. 8A, carrier 21K requires a radius 45 at the intersection of slot 44 with beveled face 41 to facilitate sliding stop head 31 up and over peak 42. The additional options provided with slot 44 would be found useful in certain installations, for example, where the tool needs to be repositioned on strap tail 22.

Three Element Tool—Operation

Turning now to FIGS. 17, 18, 19, 20, 21, 22 and 23, the operation of three element tool 50 is summarized. A self-locking bundle tie strap 16 having a strap head 19 and strap tail 22 is looped about a plurality of articles to be formed into a bundle. The loop is formed by threading tail 22 of strap 16 through an aperture in head 19. Also located in head 19 is a one-way locking device (not shown) which will permit strap 16 to be drawn up on the bundle but prevented the loop from being opened by a force applied to strap 16. Strap head 19 thus holds strap tail 22 when strap 16 is drawn up to a hand tight condition. Stop assembly 80 of tool 50 is first set to the ready position within carrier assembly 70 by threading barrel portion 81 to within a thread of the forward limit of internal threads 78 such that base openings 87 and 88 align with "bow tie" shaped opening 57. Setting stop assembly 80 to the ready position may be accomplished by inserting the tail 22 of a like strap 26 partially into shaped head 85 from the rear opening of internally threaded acrylic plastic cylinder 77 and screwing stop assembly 80 forward while sighting through "bow tie" shaped opening 57 to align base opening 88 with said opening 57. As shown in FIG. 17, tool 50 is held between a thumb and the tips of two opposing fore fingers. With stop assembly 80 set to the ready position, strap tail 22 is introduced through "bow tie" shaped opening 57 of cutter wheel assembly 51. Brass guide angles 62 and 63 aid in centering strap tail 22 along the longitudinal axis of tool 50. Thence strap tail 22 passes through base openings 88 and 87 within stop assembly 80 allowing tool 50 to slide forward to the initial position wherein razor blade pieces 64 and 65 bear on the rear face of stop head 19. Depending on orientation with strap tail 22, pawl finger 73 (best shown in FIG. 7)of either shaped head 84 or shaped head 85 prevents withdrawal of strap tail 22. Carrier assembly 70 is then rotated in the free direction about cutter wheel assembly 51 which through drive flanges 58 and 59 transmits drag forces to strap tail 22. Said rotation of carrier assembly 70 about cutter wheel assembly 51 causes stop assembly 80 to be carried rearward until friction between external threads 82 and internal threads 78 builds to overcome the torsional stiffness of strap tail 22 halting thread travel. Strap tail 22 is lightly tensioned between strap head 19 and stop assembly 80 by said rotation. With strap tail 22 thus tensioned, strap 16 may be tightened by rocking tool 50 about strap head 19 within the plane formed by the loop of strap 16. In this manner tool 50 becomes a tightening lever using the rear face of strap head 19 as a fulcrum. Said rocking of tool 50 will pull strap tail 22 through strap head 19 reducing the tension on strap tail 22 between strap head 19 and stop assembly 80. To continue the efficient tightening of strap 16, light tension on strap tail 22 must be restored by again rotating carrier assembly 70 in the free direction about cutter wheel assembly 51. By resistance to the rocking motion of tool 50, the operator will determine the point at which sufficient tightening of strap 16 about a plurality of articles has been reached. When strap 16 is determined to be sufficiently tight, excess strap tail 22 may be cut off by rotating carrier assembly 70 in the direction which engages cutter wheel assembly 51, thereby bringing either or both razor blade pieces 64 and 65 into severing contact with said excess strap tail 22. In order to produce a clean cut flush with strap head 19 and avoid an undesirable strap tail burr, tool 50 should be returned to its initial position normal to strap head 19 and rotated first in the free direction to lightly retension strap tail 22 before cutter wheel assembly 51 is engaged.

While there have been shown and described and pointed out the fundamental novel features of the invention as applied to the preferred embodiments, it will be understood that various omissions and substitutions and changes of the form and details of the device illustrated and in their operation may be made by those skilled in the art, without departing from the spirit of the invention. For instance, incorporating additional functions for the tool, such as that of a cap for a pen.

I claim:

1. A tool for use in tightening and trimming the excess tail portion of a self-locking strap installed about a plurality of articles, said self-locking strap having a stop head, said tool having a longitudinal axis and comprising:

(a) a carrier lever of rigid material of a size to be easily held and manipulated by hand and shaped to accommodate the protruding tail of said self-locking strap before and in combination with the stop head of a like strap, said carrier lever having a forward end, said forward end of said carrier lever including fulcrum means for bearing on said stop head of said self-locking strap, (b) a strap cutter means integral with the forward end of said carrier lever to sever said excess tail portion during the course of rotating about the longitudinal axis of said tool.

2. The tool of claim 1 wherein said carrier lever has a rear face, and wherein said rear face of said carrier lever is a plain surface normal to said longitudinal axis of said tool.

3. A tool for use in tightening and trimming the excess tail portion of a of a self-locking strap installed about a plurality of articles, said tool having a longitudinal axis and comprising:

(a) a carrier lever of rigid material of a size to be easily held and manipulated by hand and shaped to accommodate the protruding tail of said self-locking strap before and in combination with the stop head of a like strap, said stop head having an extreme base edge, said carrier lever having a forward end and a rear face, said rear face of said carrier lever is a plain surface normal to said longitudinal axis of said tool, said rear face is modified to accommodate said extreme base edge of said stop head in a levering groove; and (b) a strap cutter means integral with the forward end of said carrier lever to sever said excess tail portion during the course of rotating about the longitudinal axis of said tool.

4. A tool for use in tightening and trimming the excess tail portion of a of a self-locking strap installed about a plurality of articles, said tool having a longitudinal axis and comprising:

(a) a carrier lever of rigid material of a size to be easily held and manipulated by hand and shaped to accommodate the protruding tail of said self-locking strap before and in combination with the stop head of a like strap, said carrier lever having a forward end and a rear face, said rear face is modified to incorporate a quarter turn two lead helix as a strap tail tensioning means; and (b) a strap cutter means integral with the forward end of said carrier lever to sever said excess tail portion during the course of rotating about the longitudinal axis of said tool.

5. A tool for use in tightening and trimming the excess tail portion of a of a self-locking strap installed about a plurality of articles, said tool having a longitudinal axis and comprising:

(a) a carrier lever of rigid material of a size to be easily held and manipulated by hand and shaped to accommodate the protruding tail of said self-locking strap before and in combination with the stop head of a like strap, said carrier lever having a forward end and a rear face, said rear face is modified to incorporate a pair of beveled faces intersecting to form a peak, thereby providing a loose and tensioned positioning means for said stop head on said strap tail; and (b) a strap cutter means integral with the forward end of said carrier lever to sever said excess tail portion during the course of rotating about the longitudinal axis of said tool.

6. A tool for use in tightening and trimming the excess tail portion of a of a self-locking strap installed about a plurality of articles, said tool having a longitudinal axis and comprising:

(a) a carrier lever of rigid material of a size to be easily held and manipulated by hand and shaped to accommodate the protruding tail of said self-locking strap before and in combination with the stop head of a like strap, said stop head having an extreme base edge, said carrier lever having a forward end and a rear face, said rear face of said carrier lever is a plain surface normal to said longitudinal axis of said tool; and (b) a strap cutter means integral with the forward end of said carrier lever to sever said excess tail portion during the course of rotating about the longitudinal axis of said tool, said strap cutter means having a receiving port;

said carrier lever having a slot cut radially through one side thereof joining the receiving port of said strap cutter means thereby allowing the placing or removing of said tool on said strap tail while said stop head is in its initial position on said strap tail.

7. The tool of claim 6 wherein said rear face is modified to incorporate a levering groove accommodating the extreme base edge of said stop head while tensioning said strap tail.

8. The tool of claim 6 wherein said rear face is modified to incorporate a pair of beveled faces intersecting to form a peak thereby providing a loose and a tensioned positioning means for said stop head on said strap tail.

9. A tool for use in tightening and trimming the excess tail portion of a self-locking strap installed about a plurality of articles comprising:

(a) a strap cutter wheel assembly having a ratchet means allowing free rotation in one direction only, having parallel blades on the front surface of said cutter wheel assembly occupying diagonally opposite corners of a center opening, said opening loosely accommodating the tail of said self-locking strap, (b) a stop assembly having ratchet fingers 180° apart oriented to slide in the forward direction only on said strap tail, said stop assembly provided with external threads, (c) a carrier assembly means retaining and bearing axially on said cutter wheel assembly, said carrier assembly means mounted axially to an internally threaded cylinder, said stop assembly on said strap tail carrying rearward within said internally threaded cylinder when said carrier assembly means is rotated in the free direction around said cutter wheel assembly thereby tensioning said strap tail, said carrier assembly means becoming a tightening lever for the loop of said self-locking strap about a plurality of articles when said carrier assembly means is rocked within the plane of said loop using the rear face of the head of said self-locking strap as a fulcrum, rotating said carrier assembly means in the opposite direction engaging said cutter wheel assembly thereby bringing said blades into severing contact with said excess tail portion.

10. The tool of claim 9 wherein said carrier assembly means is of a size requiring the use of a thumb and the tips of two opposing fore fingers only to operate.

11. A tool for use in tightening and trimming the excess tail portion of a of a self-locking strap installed about a plurality of articles, said self-locking strap having a stop head, said tool having a longitudinal axis and comprising in combination:

(a) a strap cutter means to sever the excess tail portion of an installed self-locking strap when rotated about the longitudinal axis of the tool when bearing normally on said stop head of said self-locking strap, (b) a carrier lever of rigid material accommodating through insertion of the tail of said self-locking strap, having a forward end, and having said strap cutter means at said forward end, said forward end of said carrier lever including fulcrum means for bearing on an edge of said stop head of said self-locking strap, said fulcrum means having a first fulcrum groove and a second fulcrum groove.

12. The tool of claim 11 wherein said strap cutter means is integral with the front of said carrier lever.

13. The tool of claim 11 wherein said carrier lever while accommodating the tail of said self-locking strap between said strap cutter means and a stop head on said tail provides a tensioning means for said tail.

14. The tool of claim 13 wherein said self-locking strap forms a loop about said plurality of articles; and wherein said carrier lever uses said self-locking strap head as a fulcrum in combination with said fulcrum means of said forward end of said carrier lever when said carrier lever is rocked within the plane of said loop.

* * * * *